US011149590B2

(12) United States Patent
Sippel et al.

(10) Patent No.: US 11,149,590 B2
(45) Date of Patent: Oct. 19, 2021

(54) CERAMIC MATRIX COMPOSITE JOINTS

(71) Applicants: Rolls-Royce Corporation, Indianapolis, IN (US); Rolls-Royce High Temperature Composites, Inc., Cypress, CA (US); Rolls-Royce North American Technologies Inc., Indianapolis, IN (US)

(72) Inventors: Aaron D. Sippel, Zionsville, IN (US); Ted J. Freeman, Danville, IN (US); Joseph P. Lamusga, Long Beach, CA (US); Daniel K. Vetters, Indianapolis, IN (US); Sean E. Landwehr, Avon, IN (US); Bruce E. Varney, Greenwood, IN (US)

(73) Assignees: Rolls-Royce Corporation, Indianapolis, IN (US); Rolls-Royce High Temperature Composites, Inc., Cypress, CA (US); Rolls-Roycfe North American Technologies Inc., Indianapolis, IN (US)

( * ) Notice: Subject to any disclaimer, the term of this patent is extended or adjusted under 35 U.S.C. 154(b) by 134 days.

(21) Appl. No.: 15/992,976

(22) Filed: May 30, 2018

(65) Prior Publication Data

US 2018/0371947 A1 Dec. 27, 2018

Related U.S. Application Data

(60) Provisional application No. 62/522,975, filed on Jun. 21, 2017.

(51) Int. Cl.

| | |
|---|---|
| ***F01D 25/24*** | (2006.01) |
| ***F01D 25/00*** | (2006.01) |
| ***F01D 11/00*** | (2006.01) |

(52) U.S. Cl.

CPC ..... *F01D 25/246* (2013.01); *F01D 11/005* (2013.01); *F01D 25/005* (2013.01); *F05D 2220/32* (2013.01); *F05D 2230/237* (2013.01); *F05D 2240/11* (2013.01); *F05D 2240/128* (2013.01); *F05D 2240/15* (2013.01); *F05D 2240/35* (2013.01); *F05D 2250/12* (2013.01); *F05D 2250/711* (2013.01); *F05D 2260/36* (2013.01); *F05D 2300/6033* (2013.01)

(58) Field of Classification Search

None

See application file for complete search history.

(56) References Cited

U.S. PATENT DOCUMENTS

| | | | |
|---|---|---|---|
| 6,648,597 | B1 | 11/2003 | Widrig et al. |
| 8,235,670 | B2 | 8/2012 | Morrison et al. |
| 8,753,073 | B2 | 6/2014 | Albers et al. |
| 9,212,560 | B2 | 12/2015 | McCaffrey |
| 10,208,614 | B2 * | 2/2019 | Hafner ..... F01D 9/041 |

(Continued)

OTHER PUBLICATIONS

Department of Energy Report (DOE/CE/41000-3)—Melt Infiltrated Ceramic Composites for Gas Turbine Engine Applications (Phase II Final Report).

*Primary Examiner* — Ehud Gartenberg
*Assistant Examiner* — Jacek Lisowski
(74) *Attorney, Agent, or Firm* — Barnes & Thornburg LLP

(57) ABSTRACT

An assembly for a gas turbine engine includes ceramic material containing (i.e. ceramic matrix composite) segments and joints that couple the segments together.

16 Claims, 4 Drawing Sheets

(56) References Cited

U.S. PATENT DOCUMENTS

| | | | | |
|---|---|---|---|---|
| 2012/0055609 | A1 | 3/2012 | Blanchard et al. | |
| 2012/0275898 | A1* | 11/2012 | McCaffrey | F01D 11/18 415/1 |
| 2014/0030072 | A1* | 1/2014 | Hillier | F01D 25/24 415/173.1 |
| 2014/0030076 | A1 | 1/2014 | Herakles et al. | |
| 2014/0272274 | A1 | 9/2014 | Lazur | |
| 2016/0102576 | A1 | 4/2016 | Xu et al. | |
| 2016/0123171 | A1 | 5/2016 | Westphal et al. | |
| 2016/0265363 | A1* | 9/2016 | McCaffrey | F01D 5/284 |
| 2016/0319682 | A1 | 11/2016 | Sippel et al. | |
| 2016/0319688 | A1 | 11/2016 | Vetters et al. | |
| 2016/0319689 | A1 | 11/2016 | Vetters et al. | |
| 2016/0368827 | A1 | 12/2016 | Landwehr et al. | |

* cited by examiner

CERAMIC MATRIX COMPOSITE JOINTS

CROSS REFERENCE TO RELATED APPLICATIONS

This application claims priority to and the benefit of U.S. Provisional Patent Application No. 62/522,975, filed 21 Jun. 2017, the disclosure of which is now expressly incorporated herein by reference.

FIELD OF THE DISCLOSURE

The present disclosure relates generally to gas turbine engines, and more specifically to assemblies used in gas turbine engines made from ceramic matrix composite materials.

BACKGROUND

Ceramic matrix composite materials are being incorporated into gas turbine engine component design. These materials can withstand relatively high temperatures when compared with many metallic materials. As higher temperature operation of certain parts of a gas turbine engine can increase efficiency of the engine cycle, further use of ceramic matrix composite materials is an area of interest.

Manufacture and assembly of ceramic matrix composite material components can present challenges based on characteristics inherent to the material (strength, flexibility, etc.). In view of these challenges, various approaches to mounting, joining, and assembling ceramic matrix composite components remain an active area for new development.

SUMMARY

Assemblies comprising ceramic matrix composite materials and adapted for use in a gas turbine are described in this paper. The assemblies may include joints between segments or portions of the assembly.

In illustrative embodiments of the present disclosure, joints between segments of the assembly may include inserts received in grooves or slots formed in the segments. The inserts may be bonded to the segments via a braze layer or other suitable bond. Alternatively, the inserts may be co-infiltrated with matrix material along with the segments to integrally couple the assembly.

In illustrative embodiments, joints between segments of the assembly may be formed by interlocking fingers. The interlocking fingers may be offset from one another and shaped to fit into corresponding slots defined by fingers of another segment. In some embodiments, an insert may also be included in the finger joints as they are received in grooves or slots extending into the fingers.

In illustrative embodiments, joints between segments may be provided by lap joints in which portions of the segments overlap one another. In some embodiments, fasteners may be included in the lap joint to fix the segments in place relative to one another.

These and other features of the present disclosure will become more apparent from the following description of the illustrative embodiments.

DETAILED DESCRIPTION OF THE DRAWINGS

Figure 1:
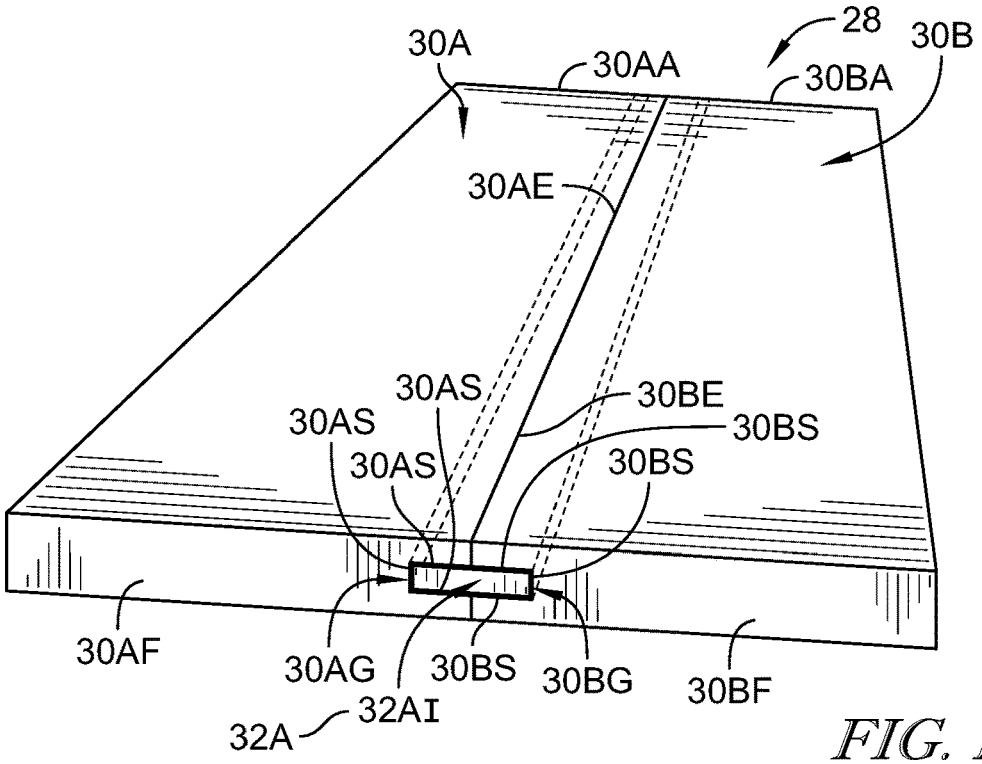
FIG. 1 is a perspective view of an assembly included in a gas turbine engine showing that the assembly includes segments and joints that couple the segments together and that the joints include rectangular-shaped inserts that are received by grooves extending axially through the segments.

For the purposes of promoting an understanding of the principles of the disclosure, reference will now be made to a number of illustrative embodiments illustrated in the drawings and specific language will be used to describe the same.

The present disclosure is directed to assemblies adapted for use a gas turbine engine where the assemblies include ceramic-matrix composite material segments or parts. Joints are formed between the segments to couple the segments to one another. For example, the illustrated assemblies/joints disclosed herein may be included in turbine blade tracks, combustion liners, exhaust system heat shields, afterburner assemblies/nozzles (use as panels/turkey feathers), and other hot area components that comprise ceramic matrix composite materials.

Referring now to FIG. 1, illustrative segments 30A, 30B of an assembly 28 are coupled to one another by a joint 32A, which may be referred to herein as a spline joint. The segment 30A includes a forward face 30AF, an aft face 30AA located aft of the forward face 30AF along a central axis 20, and a circumferential end face 30AE interconnecting the faces 30AF, 30AA. A groove 30AG extends into the circumferential end face 30AE from the forward face 30AF to the aft face 30AA. The segment 30B includes a forward face 30BF, an aft face 30BA located aft of the forward face 30BF along the central axis 20, and an end face 30BE interconnecting the faces 30BF, 30BA. A groove 30BG extends into the end face 30BE from the forward face 30BF to the aft face 30BA.

The joint 32A illustratively includes an insert 32AI that is received by the grooves 30AG, 30BG of the segments 30A, 30B as shown in FIG. 1. Receipt of the insert 32AI by the grooves 30AG, 30BG fixes the segment 30B in place relative to the segment 30A. When the insert 32AI is received by the grooves 30AG, 30BG, the insert 32AI extends substantially all the way from the forward faces 30AF, 30BF to the aft faces 30AA, 30BA.

The insert 32AI of the joint 32A is illustratively made from ceramic matrix composite materials. In other embodiments, however, the insert 32AI may be made from other materials, such as metallic materials, for example. The insert 32AI illustratively has a generally rectangular shape as shown in FIG. 1. In other embodiments, however, the insert 32AI may take the shape of other suitable geometric forms.

The groove 30AG of the track segment 30A is illustratively defined by surfaces 30AS of the segment 30A as shown in FIG. 1. Each of the surfaces 30AS is a planar surface. When the insert 32AI is received by the groove 30AG, the planar surfaces 30AS interface with planar surfaces of the insert 32AI.

The groove 30BG of the segment 30B is illustratively defined by surfaces 30BS of the segment 30B as shown in FIG. 1. Each of the surfaces 30BS is a planar surface. When the insert 32AI is received by the groove 30BG, the planar surfaces 30BS interface with planar surfaces of the insert 32AI.

In some embodiments, the joint 32A may include a bonding material. The bonding material may comprise braze material. The braze material may couple the insert 32AI to each of the track segments 30A, 30B. In other embodiments, however, the joint 32A may include bonding material that couples together the segments 30A, 30B such that the insert 32AI may be omitted.

In some embodiments, the segments 30A, 30B and the insert 32AI of the joint 32A may be joined together via co-processing. In some embodiments, the segments 30A, 30B and the insert 32AI undergo chemical vapor infiltration (CVI) processing. In some embodiments, the segments 30A, 30B and the insert 32AI are processed through slurry infiltration. In some embodiments, the segments 30A, 30B and the insert 32AI are processed through melt infiltration. The insert 32AI may provide improved strength over a matrix only/braze only joint. In some embodiments, the insert 32AI and the segments 30A, 30B may be integrally joined. In other embodiments, the segments 30A, 30B and the insert 32AI may be processed/densified as individual components and then assembled and brazed together.

Figure 2:
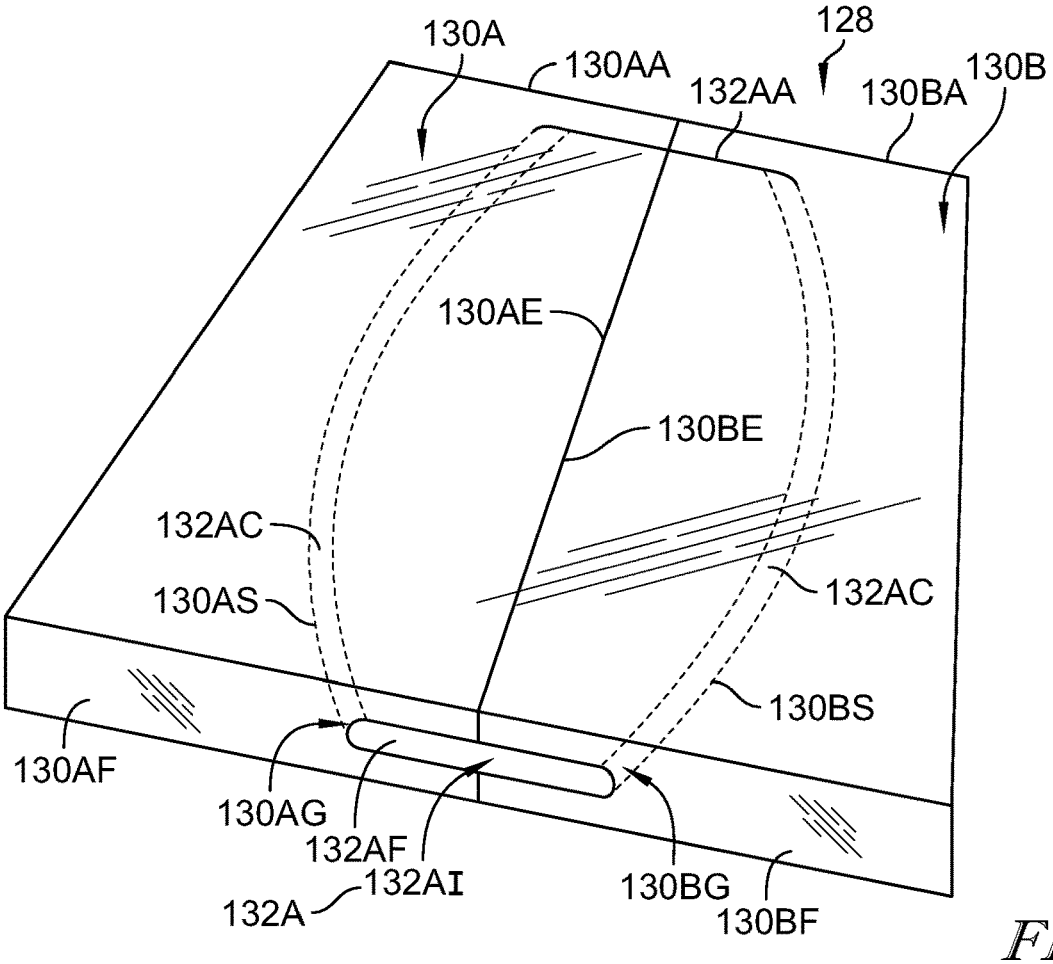
FIG. 2 is a perspective view of another assembly adapted for use in a gas turbine engine showing that the assembly includes segments and joints that couple the segments together and that the joints include inserts having convex faces that are received by grooves extending axially through the segments.

Referring now to FIG. 2, another illustrative assembly 128 is configured for use in a gas turbine engine. The assembly 128 is similar to the assembly shown in FIG. 1 and described herein.

Illustrative segments 130A, 130B of the assembly 128 are coupled to one another by a joint 132A, which may be referred to herein as a spline joint. The segment 130A includes a forward face 130AF, an aft face 130AA located aft of the forward face 130AF along a central axis (not shown), and an end face 130AE interconnecting the faces 130AF, 130AA as shown in FIG. 2. A groove 130AG extends into the end face 130AE from the forward face 130AF to the aft face 130AA. The segment 130B includes a forward face 130BF, an aft face 130BA located aft of the forward face 130BF along the central axis, and a end face 130BE interconnecting the faces 130BF, 130BA. A groove 130BG extends into the end face 130BE from the forward face 130BF to the aft face 130BA.

The joint 132A illustratively includes an insert 132AI that is received by the grooves 130AG, 130BG of the segments 130A, 130B as shown in FIG. 2. Receipt of the insert 132AI by the grooves 130AG, 130BG fixes the segment 130B in place relative to the segment 130A. When the insert 132AI is received by the grooves 130AG, 130BG, the insert 132AI extends substantially all the way from the forward faces 130AF, 130BF to the aft faces 130AA, 130BA.

The insert 132AI of the joint 132A is illustratively made from ceramic matrix composite materials. In other embodiments, however, the insert 132AI may be made from other materials, such as metallic materials, for example.

The insert 132AI illustratively includes a forward face 132AF, an aft face 132AA located aft of the forward face 132AF along the central axis, and a pair of faces 132AC arranged opposite one another that interconnect the faces 132AF, 132AA as shown in FIG. 2. The forward and aft faces 132AF, 132AA are planar faces. The pair of faces 132AC are convex faces.

The groove 130AG of the segment 130A is illustratively defined at least in part by a concave surface 130AS of the segment 130A extending substantially all the way from the forward face 130AF to the aft face 130AA as shown in FIG. 2. When the insert 132AI is received by the groove 130AG, the concave surface 130AS interfaces with one of the pair of convex faces 132AC.

The groove 130BG of the segment 130B is illustratively defined at least in part by a concave surface 130BS of the segment 130B extending substantially all the way from the forward face 130BF to the aft face 130BA as shown in FIG. 2. When the insert 132AI is received by the groove 130BG, the concave surface 130BS interfaces with one of the pair of convex faces 132AC.

In some embodiments, the joint 132A may include a bonding material. The bonding material may comprise braze material. The braze material may couple the insert 132AI to each of the track segments 130A, 130B. In other embodiments, however, the joint 132A may include bonding material that couples together the segments 130A, 130B such that the insert 132AI may be omitted.

In some embodiments, the segments 130A, 130B and the insert 132AI of the joint 132A may be joined together via co-processing. In some embodiments, the segments 130A, 130B and the insert 132AI undergo CVI processing. In some embodiments, the segments 130A, 130B and the insert 132AI are processed through slurry infiltration. In some embodiments, the segments 130A, 130B and the insert 132AI are processed through melt infiltration. The insert 132AI may provide improved strength over a matrix only/ braze only joint. In some embodiments, the insert 132AI and the segments 130A, 130B may be integrally joined. In other embodiments, the segments 130A, 130B and the insert 132AI may be processed/densified as individual components and then assembled and brazed together Operational loads may be transferred between the segments 130A, 130B by the insert 132AI of the joint 132A in a manner different from the manner in which operational loads are transferred between the segments 30A, 30B by the insert 32AI of the joint 32A. The planar shape of the surfaces of the insert 32AI extending between the faces 30AF, 30BF and the faces 30AA, 30BA may be associated with a first degree of load transfer by the insert 32AI between the segments 30A, 30B. Similarly, the convex shape of the surfaces 132AC of the insert 132AI may be associated with a second degree of load transfer by the insert 132AI between the segments 130A, 130B. The first degree of load transfer may be less gradual than the second degree of load transfer.

Figure 3:
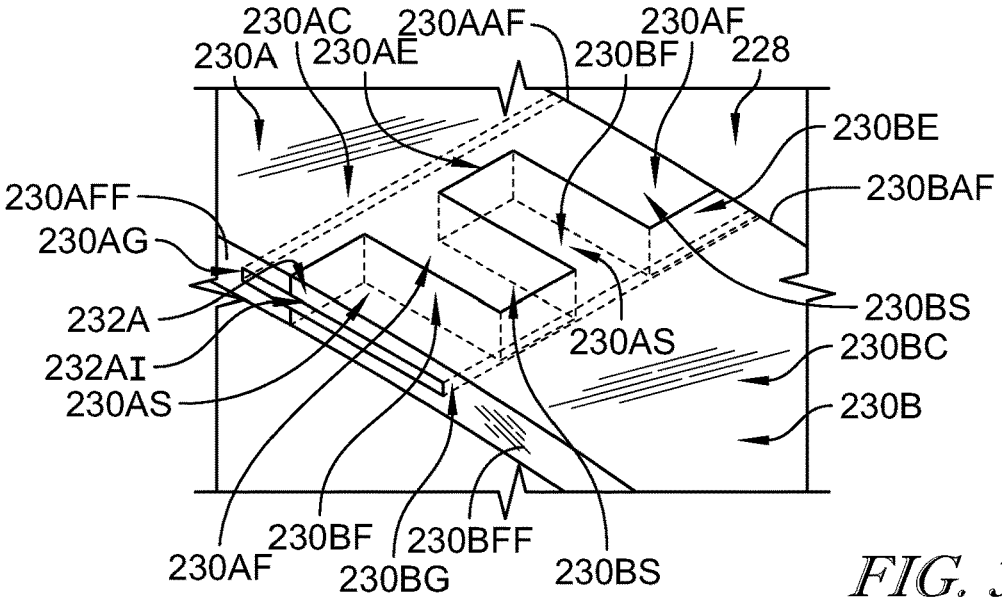
FIG. 3 is a perspective view of another assembly adapted for use in a gas turbine engine showing that the assembly includes segments having fingers and slots that interface with one another to couple the segments together and that rectangular-shaped inserts are received by the segments to further secure the segments to each other.

Referring now to FIG. 3, another illustrative assembly 228 is configured for use in a gas turbine engine. The assembly 228 is similar to the assembly 28 shown in FIG. 1 and described herein.

Illustrative segments 230A, 230B of the assembly 228 are coupled to one another as shown in FIG. 3. The segment 230A includes a central portion 230AC and an end portion 230AE spaced from the central portion 230AC. The end portion 230AE includes fingers 230AF extending away from the central portion 230AC and slots 230AS each defined by the portion 230AC and at least one of the fingers 230AF. The segment 230B includes a central portion 230BC and an end portion 230BE spaced from the central portion 230BC. The end portion 230BE includes fingers 230BF extending away from the central portion 230BC and slots 230BS each defined by the portion 230BC and at least one of the fingers 230BF.

The fingers 230AF of the segment 230A illustratively include two fingers 230AF as shown in FIG. 3. Similarly, the slots 230AS of the segment 230A illustratively include two slots 230AS. In other embodiments, however, the fingers 230AF may include another suitable number of fingers 230AF and the slots 230AS may include another suitable number of slots 230AS.

Each of the fingers 230AF of the segment 230A illustratively has a generally rectangular shape as shown in FIG. 3. Similarly, each of the slots 230AS of the segment 230A illustratively has a generally rectangular shape. In other embodiments, however, the fingers 230AF and the slots 230AS may take the shape of other suitable geometric forms.

The fingers 230BF of the track segment 230B illustratively include two fingers 230BF as shown in FIG. 3. Similarly, the slots 230BS of the segment 230B illustratively include two slots 230BS. In other embodiments, however, the fingers 230BF may include another suitable number of fingers 230BF and the slots 230BS may include another suitable number of slots 230BS.

Each of the fingers 230BF of the segment 230B illustratively has a generally rectangular shape as shown in FIG. 3. Similarly, each of the slots 230BS of the segment 230B illustratively has a generally rectangular shape. In other embodiments, however, the fingers 230BF and the slots 230BS may take the shape of other suitable geometric forms.

The fingers 230AF of the segment 230A are illustratively received by the slots 230BS of the segment 230B as shown in FIG. 3. The fingers 230BF of the segment 230B are illustratively received by the slots 230AS of the segment 230A. Consequently, the fingers 230AF and the slots 230BS and the fingers 230BF and the slots 230AS cooperate to at least partially establish a joint 232A to secure the segment 230B to the segment 230A. The joint 232A may be referred to herein as a finger joint.

Referring still to FIG. 3, the segment 230A illustratively includes a forward face 230AFF, an aft face 230AAF located aft of the forward face 230AFF along a central axis (not shown), and a groove 230AG. The groove 230AG extends into the segment 230A from the forward face 230AFF to the aft face 230AAF.

The segment 230B illustratively includes a forward face 230BFF, an aft face 230BAF located aft of the forward face 230BFF along the central axis, and a groove 230BG as shown in FIG. 3. The groove 230BG extends into the segment 230B from the forward face 230BFF to the aft face 230BAF.

The illustrative assembly 228 also includes an insert 232AI that couples the segment 230A to the segment 230B as shown in FIG. 3. The insert 232AI is received by the grooves 230AG, 230BG of the segments 230A, 230B. Receipt of the insert 232AI by the grooves 230AG, 230BG secures the segments 230A, 230B to one another in similar fashion to the joint 232A established therebetween. When the insert 232AI is received by the grooves 230AG, 230BG, the insert 232AI extends substantially all the way from the forward faces 230AFF, 230BFF to the aft faces 230AAF, 230BAF.

The insert 232AI is illustratively made from ceramic matrix composite materials. In other embodiments, however, the insert 232AI may be made from other materials, such as metallic materials, for example. The insert 232AI illustratively has a generally rectangular shape as shown in FIG. 3. In other embodiments, however, the insert 232AI may take the shape of other suitable geometric forms.

In some embodiments, the joint 232A may include a bonding material. The bonding material may comprise braze material. The braze material may couple the insert 232AI to each of the segments 230A, 230B. In other embodiments, however, the joint 232A may include bonding material that couples together the segments 230A, 230B such that the insert 232AI may be omitted.

In some embodiments, the segments 230A, 230B and the insert 232AI may be joined together via co-processing. In some embodiments, the segments 230A, 230B and the insert 232AI undergo CVI processing. In some embodiments, the segments 230A, 230B and the insert 232AI are processed through slurry infiltration. In some embodiments, the segments 230A, 230B and the insert 232AI are processed through melt infiltration. The insert 232AI may provide improved strength over a matrix only/braze only joint. In some embodiments, the insert 232AI and the segments 230A, 230B may be integrally joined. In other embodiments, the segments 230A, 230B and the insert 232AI may be processed/densified as individual components and then assembled and brazed together.

Figure 4:
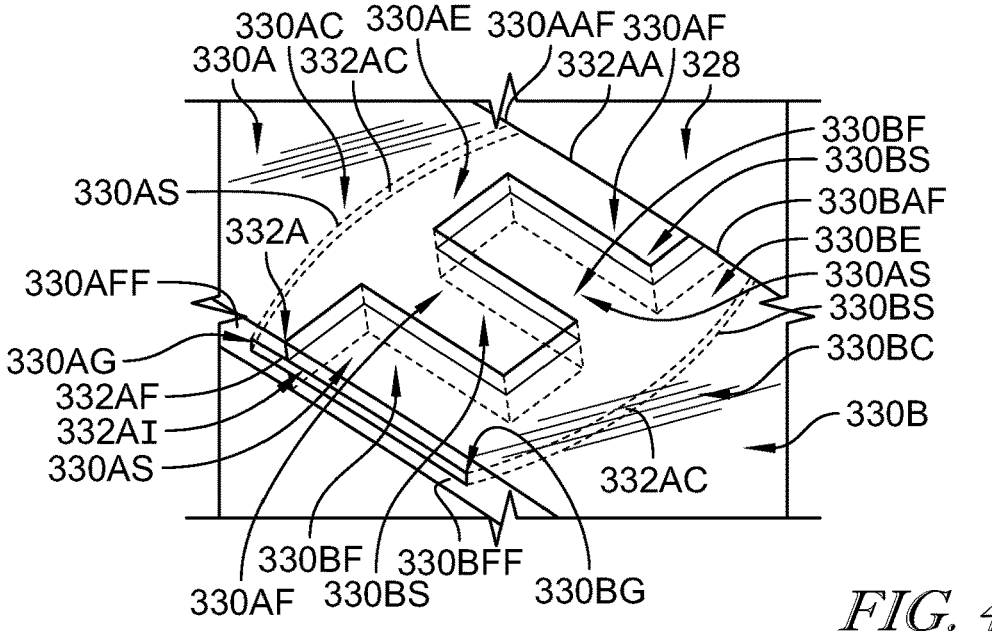
FIG. 4 is a perspective view of another assembly adapted for use in a gas turbine engine showing that the assembly includes segments having fingers and slots that interface with one another to couple the segments together and that inserts having convex faces are received by the segments to further secure the segments to each other.

Referring now to FIG. 4, another illustrative assembly 328 is configured for use in a gas turbine engine. The assembly 328 is similar to the assembly 28 shown in FIG. 1 and described herein.

Illustrative segments 330A, 330B of the assembly 328 are coupled to one another as shown in FIG. 4. The segment 330A includes a central portion 330AC and an end portion 330AE circumferentially spaced from the central portion 330AC. The end portion 330AE includes fingers 330AF extending away from the central portion 330AC and slots 330AS each defined by the portion 330AC and at least one of the fingers 330AF. The segment 330B includes a central portion 330BC and an end portion 330BE circumferentially spaced from the central portion 330BC. The end portion 330BE includes fingers 330BF extending away from the central portion 330BC and slots 330BS each defined by the portion 330BC and at least one of the fingers 330BF.

The fingers 330AF of the segment 330A illustratively include two fingers 330AF as shown in FIG. 4. Similarly, the slots 330AS of the segment 330A illustratively include two slots 330AS. In other embodiments, however, the fingers 330AF may include another suitable number of fingers 330AF and the slots 330AS may include another suitable number of slots 330AS.

Each of the fingers 330AF of the segment 330A illustratively has a generally rectangular shape as shown in FIG. 4. Similarly, each of the slots 330AS of the segment 330A illustratively has a generally rectangular shape. In other embodiments, however, the fingers 330AF and the slots 330AS may take the shape of other suitable geometric forms.

The fingers 330BF of the segment 330B illustratively include two fingers 330BF as shown in FIG. 4. Similarly, the slots 330BS of the segment 330B illustratively include two slots 330BS. In other embodiments, however, the fingers 330BF may include another suitable number of fingers 330BF and the slots 330BS may include another suitable number of slots 330BS.

Each of the fingers 330BF of the segment 330B illustratively has a generally rectangular shape as shown in FIG. 4. Similarly, each of the slots 330BS of the segment 330B illustratively has a generally rectangular shape. In other embodiments, however, the fingers 330BF and the slots 330BS may take the shape of other suitable geometric forms.

The fingers 330AF of the segment 330A are illustratively received by the slots 330BS of the segment 330B as shown in FIG. 4. The fingers 330BF of the segment 330B are illustratively received by the slots 330AS of the segment 330A. Consequently, the fingers 330AF and the slots 330BS and the fingers 330BF and the slots 330AS cooperate to at least partially establish a joint 332A to secure the segment 330B to the segment 330A. The joint 332A may be referred to herein as a finger joint.

Referring still to FIG. 4, the segment 330A illustratively includes a forward face 330AFF, an aft face 330AAF located aft of the forward face 330AFF, and a groove 330AG. The groove 330AG extends into the segment 330A from the forward face 330AFF to the aft face 330AAF.

The segment 330B illustratively includes a forward face 330BFF, an aft face 330BAF located aft of the forward face 330BFF, and a groove 330BG as shown in FIG. 4. The groove 330BG extends into the segment 330B from the forward face 330BFF to the aft face 330BAF.

The illustrative assembly 328 also includes an insert 332AI that couples the segment 330A to the segment 330B as shown in FIG. 4.

The insert 332AI is received by the grooves 330AG, 330BG of the segments 330A, 330B. Receipt of the insert 332AI by the grooves 330AG, 330BG secures the segments 330A, 330B to one another in similar fashion to the joint 332A established therebetween. When the insert 332AI is received by the grooves 330AG, 330BG, the insert 332AI extends substantially all the way from the forward faces 330AFF, 330BFF to the aft faces 330AAF, 330BAF.

The insert 332AI is illustratively made from ceramic matrix composite materials. In other embodiments, however, the insert 332AI may be made from other materials, such as metallic materials, for example.

The insert 332AI illustratively includes a forward face 332AF, an aft face 332AA located aft of the forward face 332AF, and a pair of faces 332AC arranged opposite one another that interconnect the faces 332AF, 332AA as shown in FIG. 4. The forward and aft faces 332AF, 332AA are planar faces. The pair of faces 332AC are convex faces.

The groove 330AG of the segment 330A is illustratively defined at least in part by a concave surface 330AS of the segment 330A extending substantially all the way from the forward face 330AFF to the aft face 330AAF as shown in FIG. 4. When the insert 332AI is received by the groove 330AG, the concave surface 330AS interfaces with one of the pair of convex faces 332AC.

The groove 330BG of the segment 330B is illustratively defined at least in part by a concave surface 330BS of the segment 330B extending substantially all the way from the forward face 330BFF to the aft face 330BAF as shown in FIG. 4. When the insert 332AI is received by the groove 330BG, the concave surface 330BS interfaces with one of the pair of convex faces 332AC.

In some embodiments, the joint 332A may include a bonding material. The bonding material may comprise braze material. The braze material may couple the insert 332AI to each of the segments 330A, 330B. In other embodiments, however, the joint 332A may include bonding material that couples together the segments 330A, 330B such that the insert 332AI may be omitted.

In some embodiments, the segments 330A, 330B and the insert 332AI may be joined together via co-processing. In some embodiments, the segments 330A, 330B and the insert 332AI undergo CVI processing. In some embodiments, the segments 330A, 330B and the insert 332AI are processed through slurry infiltration. In some embodiments, the segments 330A, 330B and the insert 332AI are processed through melt infiltration. The insert 332AI may provide improved strength over a matrix only/braze only joint. In some embodiments, the insert 332AI and the segments 330A, 330B may be integrally joined. In other embodiments, the segments 330A, 330B and the insert 332AI may be processed/densified as individual components and then assembled and brazed together.

Operational loads may be transferred between the segments 330A, 330B by the insert 332AI in a manner different from the manner in which operational loads are transferred between the segments 230A, 230B by the insert 232AI. The planar shape of the surfaces of the insert 232AI extending between the faces 230AFF, 230BFF and the faces 230AAF, 230BAF may be associated with a first degree of load transfer by the insert 232AI between the segments 230A, 230B. Similarly, the convex shape of the surfaces 332AC of the insert 332AI may be associated with a second degree of load transfer by the insert 332AI between the segments 330A, 330B. The first degree of load transfer may be less gradual than the second degree of load transfer.

Figure 5:
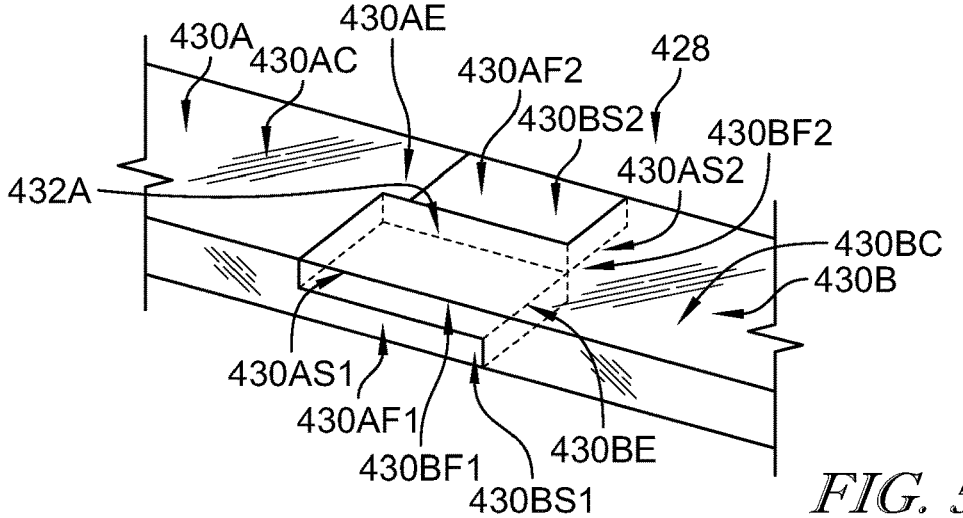
FIG. 5 is a perspective view of another assembly adapted for use in a gas turbine engine showing that the assembly includes segments having fingers and slots that interface with one another to couple the segments together.

Referring now to FIG. 5, another illustrative assembly 428 is configured for use in a gas turbine engine. The assembly 428 is similar to the assembly 28 shown in FIG. 1 and described herein.

Illustrative segments 430A, 430B of the assembly 428 are coupled to one another as shown in FIG. 5. The segment 430A includes a central portion 430AC and an end portion 430AE circumferentially spaced from the central portion 430AC. The end portion 430AE includes fingers 430AF extending away from the central portion 430AC and slots 430AS each defined by the portion 430AC and at least one of the fingers 430AF. The segment 430B includes a central portion 430BC and an end portion 430BE circumferentially spaced from the central portion 430BC. The end portion 430BE includes fingers 430BF extending away from the central portion 430BC and slots 430BS each defined by the portion 430BC and at least one of the fingers 430BF.

The fingers 430AF of the segment 430A illustratively include two fingers 430AF as shown in FIG. 5. Similarly, the slots 430AS of the segment 430A illustratively include two slots 430AS. In other embodiments, however, the fingers 430AF may include another suitable number of fingers 430AF and the slots 430AS may include another suitable number of slots 430AS.

Each of the fingers 430AF of the segment 430A illustratively has a generally rectangular shape as shown in FIG. 5. Similarly, each of the slots 430AS of the segment 430A illustratively has a generally rectangular shape. In other embodiments, however, the fingers 430AF and the slots 430AS may take the shape of other suitable geometric forms.

In the illustrative embodiment, the finger 430AF1 of the segment 430A is generally positioned radially inward and axially forward of the finger 430AF2 of the segment 430A as shown in FIG. 5. Additionally, in the illustrative embodiment, the slot 430AS1 of the segment 430A is generally positioned radially outward and axially forward of the slot 430AS2 of the segment 430A as shown in FIG. 5. As such, the fingers 430AF1, 430AF2 and the slots 430AS1, 430AS2 may be said to be diagonally opposed to one another.

The fingers 430BF of the segment 430B illustratively include two fingers 430BF as shown in FIG. 5. Similarly, the slots 430BS of the segment 430B illustratively include two slots 430BS. In other embodiments, however, the fingers 430BF may include another suitable number of fingers 430BF and the slots 430BS may include another suitable number of slots 430BS.

Each of the fingers 430BF of the segment 430B illustratively has a generally rectangular shape as shown in FIG. 5. Similarly, each of the slots 430BS of the segment 430B illustratively has a generally rectangular shape. In other embodiments, however, the fingers 430BF and the slots 430BS may take the shape of other suitable geometric forms.

In the illustrative embodiment, the finger 430BF1 of the segment 430B is generally positioned radially outward and axially forward of the finger 430BF2 of the segment 430B as shown in FIG. 5. Additionally, in the illustrative embodiment, the slot 430BS1 of the segment 430B is generally positioned radially inward and axially forward of the slot 430BS2 of the segment 430B as shown in FIG. 5. As such, the fingers 430BF1, 430BF2 and the slots 430BS1, 430BS2 may be said to be diagonally opposed to one another.

The fingers 430AF of the segment 430A are illustratively received by the slots 430BS of the segment 430B as shown in FIG. 5. The fingers 430BF of the segment 430B are illustratively received by the slots 430AS of the segment 430A. Consequently, the fingers 430AF and the slots 430BS and the fingers 430BF and the slots 430AS cooperate to at least partially establish a joint 432A to secure the segment 430B to the segment 430A. The joint 432A may be referred to herein as a finger joint.

In some embodiments, the segments 430A, 430B may be joined together via co-processing. In some embodiments, the segments 430A, 430B undergo CVI processing. In some embodiments, the segments 430A, 430B are processed through slurry infiltration. In some embodiments, the segments 430A, 430B are processed through melt infiltration. In some embodiments, the segments 430A, 430B may be integrally joined. In other embodiments, the segments 430A, 430B may be processed/densified as individual components and then assembled and brazed together.

Figure 6:
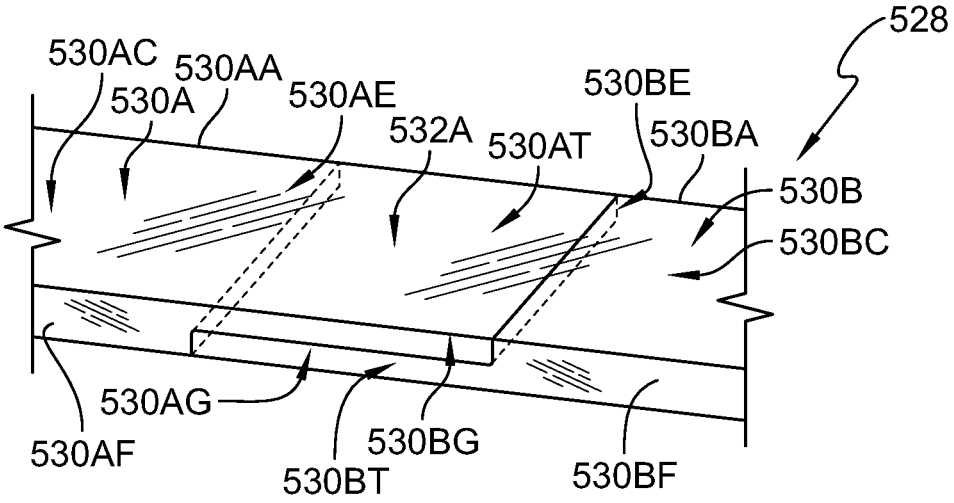
FIG. 6 is a perspective view of another assembly adapted for use in a gas turbine engine showing that the assembly includes segments having tongues and grooves that interface with one another such that the segments overlap to establish joints securing the segments together.

Referring now to FIG. 6, another illustrative assembly 528 is configured for use in a gas turbine engine. The assembly 528 is similar to the assembly 28 shown in FIG. 1 and described herein.

The illustrative assembly 528 includes a segment 530A as shown in FIG. 6. The segment 530A includes a forward face 530AF, an aft face 530AA located aft of the forward face 530AF, a central portion 530AC interconnecting the faces 530AF, 530AA, and an end portion 530AE circumferentially spaced from the central portion 530AC. The end portion 530AE has at least one tongue 530AT extending away from the central portion 530AC between the faces 530AF, 530AA and at least one groove 530AG defined by the central portion 530AC and the at least one tongue 530AT.

The at least one tongue 530AT of the segment 530A illustratively includes one tongue 530AT that extends substantially all the way from the forward face 530AF to the aft face 530AA as shown in FIG. 6. Similarly, the at least one groove 530AG of the segment 530A illustratively includes one groove 530AG that extends substantially all the way from the forward face 530AF to the aft face 530AA. The tongue 530AT is arranged radially outward of the groove 530AG. In other embodiments, however, the at least one tongue 530AT may include another suitable number of tongues 530AT and the at least one groove 530AG may include another suitable number of grooves 530AG. Additionally, in other embodiments, the at least one tongue 530AT and the at least one groove 530AG may be arranged relative to one another in another suitable arrangement.

The tongue 530AT of the segment 530A illustratively has a generally rectangular shape as shown in FIG. 6. Similarly, the groove 530AG of the segment 530A illustratively has a generally rectangular shape. In other embodiments, however, the tongue 530AT and the groove 530AG may take the shape of other suitable geometric forms.

The illustrative assembly 528 also includes a segment 530B as shown in FIG. 6. The segment 530B includes a forward face 530BF, an aft face 530BA located aft of the forward face 530BF, a central portion 530BC interconnecting the faces 530BF, 530BA, and an end portion 530BE circumferentially spaced from the central portion 530BC. The end portion 530BE has at least one tongue 530BT extending away from the central portion 530BC between the faces 530BF, 530BA and at least one groove 530BG defined by the central portion 530BC and the at least one tongue 530BT.

The at least one tongue 530BT of the segment 530B illustratively includes one tongue 530BT that extends substantially all the way from the forward face 530BF to the aft face 530BA as shown in FIG. 6. Similarly, the at least one groove 530BG of the segment 530B illustratively includes one groove 530BG that extends substantially all the way from the forward face 530BF to the aft face 530BA. The tongue 530BT is arranged radially inward of the groove 530BG. In other embodiments, however, the at least one tongue 530BT may include another suitable number of tongues 530BT and the at least one groove 530BG may include another suitable number of grooves 530BG. Additionally, in other embodiments, the at least one tongue 530BT and the at least one groove 530BG may be arranged relative to one another in another suitable arrangement.

The tongue 530BT of the segment 530B illustratively has a generally rectangular shape as shown in FIG. 6. Similarly, the groove 530BG of the segment 530B illustratively has a generally rectangular shape. In other embodiments, however, the tongue 530BT and the groove 530BG may take the shape of other suitable geometric forms.

The tongue 530AT of the segment 530A is illustratively received by the groove 530BG of the segment 530B as shown in FIG. 6. The tongue 530BT of the segment 530B is illustratively received by the groove 530AG of the segment 530A. Consequently, the segments 530A, 530B overlap each other to at least partially establish a joint 532A to secure the segment 530B to the segment 530A. The joint 532A may be referred to herein as a lap joint.

In some embodiments, the segments 530A, 530B may be joined together via co-processing. In some embodiments, the segments 530A, 530B undergo CVI processing. In some embodiments, the segments 530A, 530B are processed through slurry infiltration. In some embodiments, the segments 530A, 530B are processed through melt infiltration. In some embodiments, the segments 530A, 530B may be integrally joined. In other embodiments, the segments 530A, 530B may be processed/densified as individual components and then assembled and brazed together.

Figure 7:
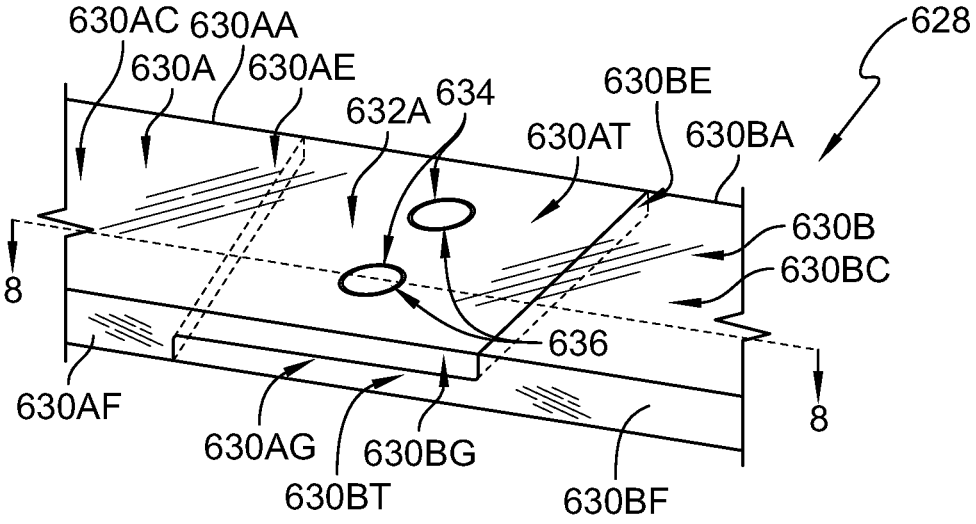
FIG. 7 is a perspective view of another assembly adapted for use in a gas turbine engine showing that the assembly includes segments having tongues and grooves that interface with one another such that the segments overlap to establish joints securing the segments together and fasteners that further secure the segments together.

Referring now to FIG. 7, another illustrative assembly 628 is configured for use in a gas turbine engine. The assembly 628 is similar to the assembly 28 shown in FIG. 1 and described herein.

The illustrative assembly 628 includes a segment 630A as shown in FIG. 7. The segment 630A includes a forward face 630AF, an aft face 630AA located aft of the forward face 630AF along, a central portion 630AC interconnecting the faces 630AF, 630AA, and an end portion 630AE circumferentially spaced from the central portion 630AC. The end portion 630AE has at least one tongue 630AT extending away from the central portion 630AC between the faces 630AF, 630AA and at least one groove 630AG defined by the central portion 630AC and the at least one tongue 630AT.

The at least one tongue 630AT of the segment 630A illustratively includes one tongue 630AT that extends substantially all the way from the forward face 630AF to the aft face 630AA as shown in FIG. 7. Similarly, the at least one groove 630AG of the segment 630A illustratively includes one groove 630AG that extends substantially all the way from the forward face 630AF to the aft face 630AA. The tongue 630AT is arranged radially outward of the groove 630AG. In other embodiments, however, the at least one tongue 630AT may include another suitable number of tongues 630AT and the at least one groove 630AG may include another suitable number of grooves 630AG. Additionally, in other embodiments, the at least one tongue 630AT and the at least one groove 630AG may be arranged relative to one another in another suitable arrangement.

The tongue 630AT of the segment 630A illustratively has a generally rectangular shape as shown in FIG. 7. Similarly, the groove 630AG of the segment 630A illustratively has a generally rectangular shape. In other embodiments, however, the tongue 630AT and the groove 630AG may take the shape of other suitable geometric forms.

The illustrative assembly 628 also includes a segment 630B as shown in FIG. 7. The segment 630B includes a forward face 630BF, an aft face 630BA located aft of the forward face 630BF, a central portion 630BC interconnecting the faces 630BF, 630BA, and an end portion 630BE circumferentially spaced from the central portion 630BC. The end portion 630BE has at least one tongue 630BT extending away from the central portion 630BC between the faces 630BF, 630BA and at least one groove 630BG defined by the central portion 630BC and the at least one tongue 630BT.

The at least one tongue 630BT of the segment 630B illustratively includes one tongue 630BT that extends substantially all the way from the forward face 630BF to the aft face 630BA as shown in FIG. 7. Similarly, the at least one groove 630BG of the segment 630B illustratively includes one groove 630BG that extends substantially all the way from the forward face 630BF to the aft face 630BA. The tongue 630BT is arranged radially inward of the groove 630BG. In other embodiments, however, the at least one tongue 630BT may include another suitable number of tongues 630BT and the at least one groove 630BG may include another suitable number of grooves 630BG. Additionally, in other embodiments, the at least one tongue 630BT and the at least one groove 630BG may be arranged relative to one another in another suitable arrangement.

The tongue 630BT of the segment 630B illustratively has a generally rectangular shape as shown in FIG. 7. Similarly, the groove 630BG of the segment 630B illustratively has a generally rectangular shape. In other embodiments, however, the tongue 630BT and the groove 630BG may take the shape of other suitable geometric forms.

The tongue 630AT of the segment 630A is illustratively received by the groove 630BG of the segment 630B as shown in FIG. 7. The tongue 630BT of the segment 630B is illustratively received by the groove 630AG of the segment 630A. Consequently, the segments 630A, 630B overlap each other to at least partially establish a joint 632A to secure the segment 630B to the segment 630A. The joint 632A may be referred to herein as a lap joint.

In some embodiments, the segments 630A, 630B may be joined together via co-processing. In some embodiments, the segments 630A, 630B undergo CVI processing. In some embodiments, the segments 630A, 630B are processed through slurry infiltration. In some embodiments, the segments 630A, 630B are processed through melt infiltration. In some embodiments, the segments 630A, 630B may be integrally joined. In other embodiments, the segments 630A, 630B may be processed/densified as individual components and then assembled and brazed together.

Figure 8:
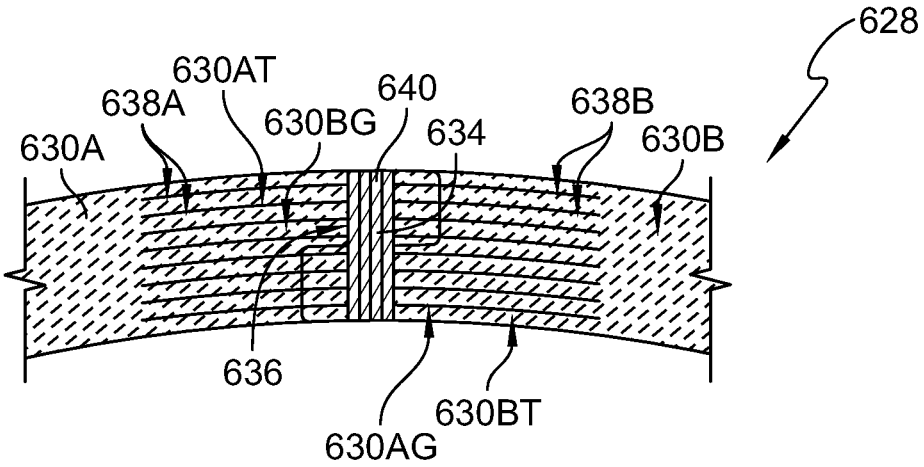
FIG. 8 is a sectional view taken along line 7-7 of FIG. 7 showing fastener fibers of one of the fasteners arranged relative to segment fibers of the segments.

The assembly 628 also includes fasteners 634 that couple the segment 630B to the segment 630A as shown in FIGS. 7 and 8. Coupling of the segment 630B to the segment 630A by the fasteners 634 secures the segments 630A, 630B to one another in similar fashion to the joint 632A established therebetween.

The fasteners 634 illustratively include two fasteners 634 as shown in FIG. 7. The fasteners 634 are illustratively made from ceramic matrix composite materials. In other embodiments, however, another suitable number of fasteners 634 made from other suitable materials may be employed.

The fasteners 634 are illustratively received by blind apertures 636 as shown in FIGS. 7 and 8. The apertures 636 are formed in the tongue 630AT of the segment 630A and the tongue 630BT of the segment 630B.

The illustrative segments 630A, 630B respectively include segment fibers 638A, 638B as shown in FIG. 8. The illustrative fasteners 634 include fastener fibers 640. The segment fibers 638A, 638B are arranged to extend substantially perpendicular to the fastener fibers 640. The arrangement of the segment fibers 638A, 638B relative to the fastener fibers 640 may resist de-coupling of the segments 630A, 630B to a greater degree than other arrangements.

Figure 9:
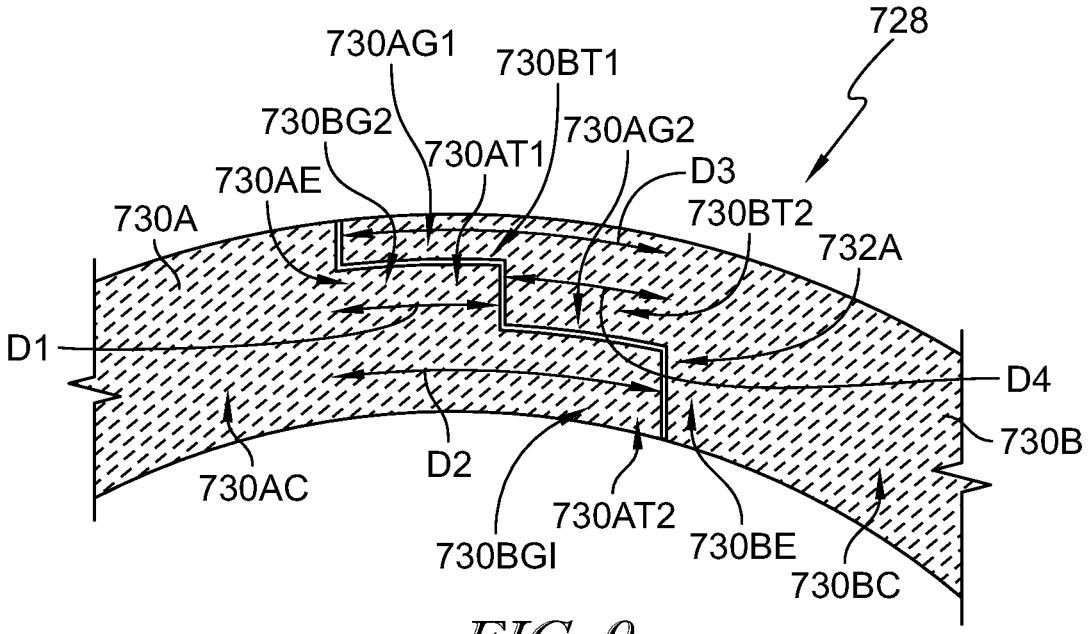
FIG. 9 is a front elevation view of another assembly adapted for use in a gas turbine engine showing that the assembly includes segments having multiple tongues and grooves arranged at different radial locations that interface with one another such that the segments overlap to establish joints securing the segments together.

Referring now to FIG. 9, another illustrative assembly 728 is configured for use in a gas turbine engine. The assembly 728 is similar to the assembly 28 shown in FIG. 1 and described herein.

The illustrative assembly 728 includes a segment 730A as shown in FIG. 9. The segment 730A includes a central portion 730AC and an end portion 730AE circumferentially spaced from the central portion 730AC. The end portion 730AE has a first tongue 730AT1 and a second tongue 730AT2 arranged radially inward of the tongue 730AT1. The tongue 730AT1 extends a circumferential distance D1 away from the central portion 730AC and the tongue 730AT2 extends a circumferential distance D2 away from the central portion 730AC. The distance D1 is illustratively less than the distance D2.

The illustrative segment 730A also includes a first groove 730AG1 and a second groove 730AG2 as shown in FIG. 9. The groove 730AG1 is defined by the central portion 730AC of the segment 730A and the tongue 730AT1 of the segment 730A. The groove 730AG2 is defined by the tongues 730AT1, 730AT2 of the segment 730A.

The illustrative assembly 728 also includes a segment 730B as shown in FIG. 9. The segment 730B includes a central portion 730BC and an end portion 730BE circumferentially spaced from the central portion 730BC. The end portion 730BE has a first tongue 730BT1 and a second tongue 730BT2 arranged radially inward of the tongue 730BT1. The tongue 730BT1 extends a circumferential distance D3 away from the central portion 730BC and the tongue 730BT2 extends a circumferential distance D4 away from the central portion 730BC. The distance D3 is illustratively greater than the distance D4.

The illustrative assembly 730B also includes a first groove 730BG1 and a second groove 730BG2 as shown in FIG. 9. The groove 730BG1 is defined by the central portion 730BC of the segment 730B and the tongue 730BT2 of the segment 730B. The groove 730BG2 is defined by the tongues 730BT1, 730BT2 of the segment 730B.

The tongues 730AT1, 730AT2 of the segment 730A are illustratively respectively received by the grooves 730BG2, 730BG1 of the segment 730B as shown in FIG. 9. The tongues 730BT1, 730BT2 of the segment 730B are illustratively respectively received by the grooves 730AG1, 730AG2 of the segment 730A. Consequently, the segments 730A, 730B overlap each other to at least partially establish a joint 732A to secure the segment 730B to the segment 730A. The joint 732A may be referred to herein as a staggered lap joint.

In some embodiments, the segments 730A, 730B may be joined together via co-processing. In some embodiments, the segments 730A, 730B undergo CVI processing. In some embodiments, the segments 730A, 730B are processed through slurry infiltration. In some embodiments, the segments 730A, 730B are processed through melt infiltration. In some embodiments, the segments 730A, 730B may be integrally joined. In other embodiments, the segments 730A, 730B may be processed/densified as individual components and then assembled and brazed together.

Figure 10:
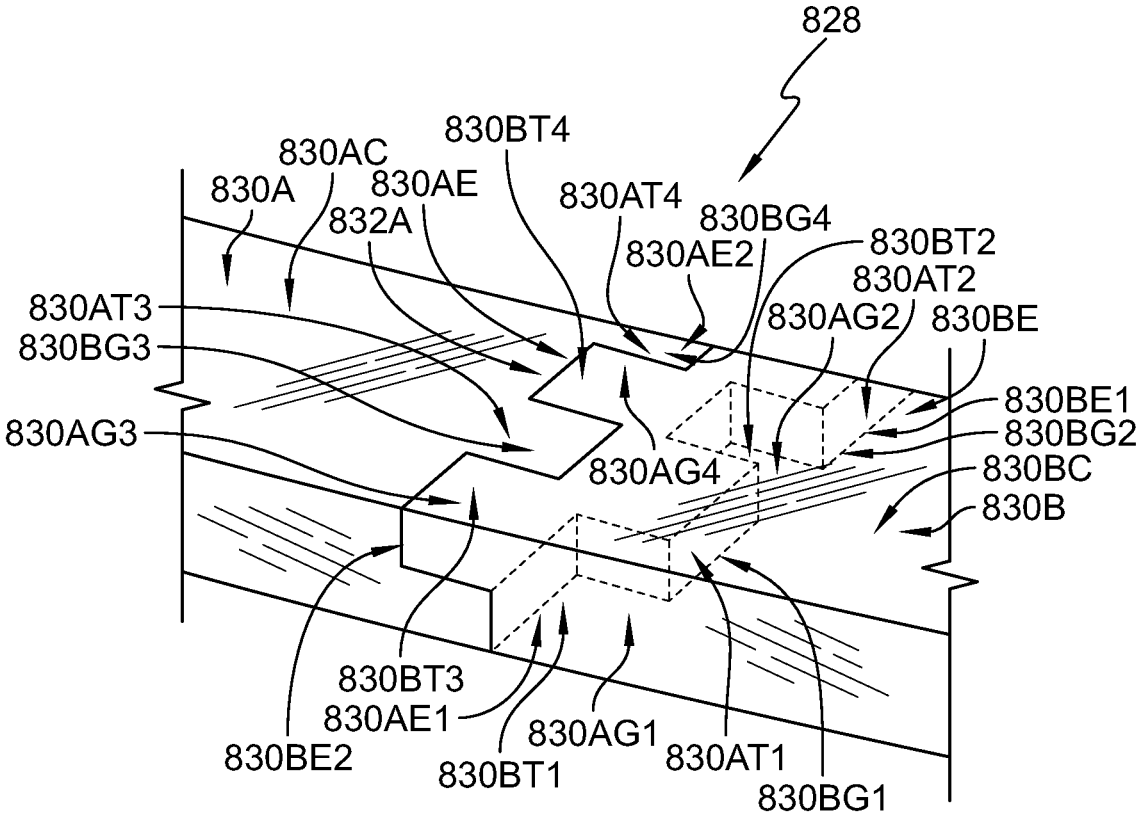
FIG. 10 is a perspective view of another assembly adapted for use in a gas turbine engine showing that the assembly includes segments having multiple sets of tongues and grooves arranged at different radial locations that interface with one another such that the segments overlap to establish joints securing the segments together.

Referring now to FIG. 10, another illustrative assembly 828 is configured for use in a gas turbine engine. The assembly 828 is similar to the blade assembly 28 shown in FIG. 1 and described herein.

The illustrative assembly 828 includes a segment 830A as shown in FIG. 10. The segment 830A includes a central portion 830AC and an end portion 830AE circumferentially spaced from the central portion 830AC. The end portion 830AE has an inner part 830AE1 and an outer part 830AE2 arranged radially outward of the inner part 830AE1.

The inner part 830AE1 of the end portion 830AE of the segment 830A illustratively includes a tongue 830AT1 and a tongue 830AT2 located axially aft of the tongue 830AT1 as shown in FIG. 10. The tongues 830AT1, 830AT2 extend away from the central portion 830AC of the segment 830A. The inner part 830AE1 also includes a groove 830AG1 and a groove 830AG2 located axially aft of the groove 830AG1. The groove 830AG1 is defined by the central portion 830AC and the tongue 830AT1. The groove 830AG2 is defined by the central portion 830AC and the tongues 830AT1, 830AT2.

The outer part 830AE2 of the end portion 830AE of the segment 830A illustratively includes a tongue 830AT3 and a tongue 830AT4 located axially aft of the tongue 830AT3 as shown in FIG. 10. The tongues 830AT3, 830AT4 extend away from the central portion 830AC of the segment 830A. The outer part 830AE2 also includes a groove 830AG3 and a groove 830AG4 located axially aft of the groove 830AG3. The groove 830AG3 is defined by the central portion 830AC and the tongue 830AT3. The groove 830AG4 is defined by the central portion 830AC and the tongues 830AT3, 830AT4.

The illustrative assembly 828 also includes a track segment 830B as shown in FIG. 10. The segment 830B includes a central portion 830BC and an end portion 830BE circumferentially spaced from the central portion 830BC. The end portion 830BE has an inner part 830BE1 and an outer part 830BE2 arranged radially outward of the inner part 830BE1.

The inner part 830BE1 of the end portion 830BE of the segment 830B illustratively includes a tongue 830BT1 and a tongue 830BT2 located axially aft of the tongue 830BT1 as shown in FIG. 10. The tongues 830BT1, 830BT2 extend away from the central portion 830BC of the segment 830B. The inner part 830BE1 also includes a groove 830BG1 and a groove 830BG2 located axially aft of the groove 830BG1. The groove 830BG2 is defined by the central portion 830BC and the tongue 830BT2. The groove 830BG1 is defined by the central portion 830BC and the tongues 830BT1, 830BT2.

The outer part 830BE2 of the end portion 830BE of the segment 830B illustratively includes a tongue 830BT3 and a tongue 830BT4 located axially aft of the tongue 830BT3 as shown in FIG. 10. The tongues 830BT3, 830BT4 extend away from the central portion 830BC of the segment 830B. The outer part 830BE2 also includes a groove 830BG3 and a groove 830BG4 located axially aft of the groove 830BG3. The groove 830BG4 is defined by the central portion 830BC and the tongue 830BT4. The groove 830BG3 is defined by the central portion 830BC and the tongues 830BT3, 830BT4.

The tongues 830AT1, 830AT2 of the segment 830A are illustratively respectively received by the grooves 830BG1, 830BG2 of the segment 830B as shown in FIG. 10. The tongues 830BT1, 830BT2 of the segment 830B are illustratively respectively received by the grooves 830AG1, 830AG2 of the segment 830A. The tongues 830AT3, 830AT4 of the segment 830A are illustratively respectively received by the grooves 830BG3, 830BG4 of the segment 830B. The tongues 830BT3, 830BT4 of the segment 830B are illustratively respectively received by the grooves 830AG3, 830AG4 of the segment 830A. Consequently, the segments 830A, 830B overlap each other to at least partially establish a joint 832A to secure the segment 830B to the segment 830A. The joint 832A may be referred to herein as a hybrid lap and finger joint.

In some embodiments, the segments 830A, 830B may be joined together via co-processing. In some embodiments, the segments 830A, 830B undergo CVI processing. In some embodiments, the segments 830A, 830B are processed through slurry infiltration. In some embodiments, the segments 830A, 830B are processed through melt infiltration. In some embodiments, the segments 830A, 830B may be integrally joined. In other embodiments, the segments 830A, 830B may be processed/densified as individual components and then assembled and brazed together.

The present disclosure may be directed to joining a number of ceramic matrix composite (CMC) segments (e.g., the segments 30) into one component (e.g., the assembly 28) considering existing manufacturing processes and the associated limitations. The concepts of this disclosure may have a broader application to other components. The segments may be at least partially densified (e.g., through a chemical vapor infiltration process). The segments may be tooled together, and the component formed from the segments may then be fully densified. The segments may be joined to form the component by existing manufacturing methods (e.g., suspect measurement identification).

The segments may be made from multiple layup configurations. In one example, the segments may be made from unidirectional plies. In another example, the segments may be made from two-dimensional woven plies. In yet another example, the segments may be made from a three-dimensional structure.

One embodiment of the present disclosure may be directed to a spline joint (e.g., the joint 32A). In that embodiment, the ends (e.g., the end portion s 30AE, 30BE) of the segments may have grooves (e.g., the grooves 30AG, 30BG) created through machining a constant thickness cast piece. Alternatively, the grooves may be produced by laying up the segments such that the forming tooling and ply lengths generate the grooves. To achieve manufacturing tolerances and control the joint gap between the segments, machined grooves may be desirable.

In any case, the spline component (e.g., the insert 32AI) may be a relatively thin plate that is machined around its edges. The top and bottom surfaces of the spline may need to be machined, but those surfaces may be left as-formed. Further testing may be desirable to determine whether the as-formed surfaces of the spline should be machined.

In another embodiment, a rounded cut may be used to provide rounded grooves (e.g., the concave surfaces 130AS, 130BS of the grooves 130AG, 130BG). In that embodiment, there may not be a plane aligned with the length of the spline (e.g., the insert 132AI) where there is only matrix/joint material. The curvature of the spline may allow loads applied to one segment (e.g., the segment 130A) to be transferred to another segment (e.g., the segment 130B) by the spline more gradually than would otherwise be the case.

In another embodiment, a spline joint concept may be combined with a finger joint concept (e.g., the joints 232A, 332A). In that embodiment, maximizing the number of portions of the joints in shear may be desirable. The capability of such joints to withstand shear stresses may be greater than the capability of the joints to withstand tensile stresses. Such configurations may provide a number of surfaces subjected to shear stresses that tend to pull apart the segments at the joints. In those configurations, pure tensile stresses may be applied only to the tips of the fingers (e.g., the tips of fingers 230AF, 230BF, 330AF, 330BF).

In another embodiment, a finger joint (e.g., the joint 432A) may be formed from features (e.g., the fingers 430AF1, 430AF2 and the slots 430AS1, 430AS2 and the fingers 430BF1, 430BF2 and the slots 430BS1, 430BS2) that are diagonally opposed of one another. In that embodiment, the area of the joint in shear may be increased compared to other configurations. Currently available forming and machining processes may be utilized with this concept.

In another embodiment, a lap joint (e.g., the joints 532A, 632A, 732A) may be provided. In that embodiment, the segments may be made by forming or machining a constant thickness preform. The segments (e.g., the segments 630A, 630B) may be coupled together using CMC pins (e.g., the fasteners 634). Regardless of the number of pins utilized, the objective may be to drive failure through the segment fibers. Each pin may have fibers (e.g., fastener fibers 640) that are oriented in the vertical/radial direction substantially normal to the segment fibers (e.g., the segment fibers 638A, 638B). Blind holes (e.g., the blind apertures 636) may be formed to receive the pins. As such, micro-cracking of the matrix joint may cause the pins to be released from the segments in at least one direction.

In another embodiment, a staggered lap joint (e.g., the joint 732A) may be provided. In that embodiment, the area of the joint in shear may be increased compared to other configurations. As such, cracks in the joint may need to turn a corner to propagate all the way through the joint.

In another embodiment, a hybrid lap and finger joint (e.g., the joint 832A) may be provided. In that embodiment, more complicated machining may be needed compared to other configurations. However, the number of shear interfaces between the segments (e.g., the segments 830A, 830B) may be increased compared to other configurations. The alignment and number of fingers (e.g., the tongues 830AT1, 830AT2, 830AT3, 830AT4, 830BT1, 830BT2, 830BT3, 830BT4) may vary depending on the application.

According to one aspect of the present disclosure, an assembly for a gas turbine engine may include a first segment, a second segment, and a joint. The first segment may comprise ceramic matrix composite materials and extend partway around a central axis. The first segment may include a forward face, an aft face located aft of the forward face along the central axis, a circumferential end face interconnecting the forward face and the aft face, and a groove extending into the circumferential end face from the forward face to the aft face. The second segment may comprise ceramic matrix composite materials and extend partway around the central axis. The second segment may include a forward face, an aft face located aft of the forward face along the central axis, a circumferential end face interconnecting the forward face and the aft face, and a groove extending into the circumferential end face from the forward face to the aft face. The joint may couple the first segment to the second segment. The joint may include an insert received by the grooves of the first and second segments to fix the second segment in place relative to the first segment. In other embodiments, the segments have different shapes such that they do not extend around an axis.

In some embodiments, the insert may extend substantially all the way from the forward faces of the first and second segments to the aft faces of the first and second segments when the insert is received by the grooves of the first and second segments. Additionally, in some embodiments, the insert may comprise ceramic matrix composite materials.

In some embodiments, the insert may have a generally rectangular shape. The groove of the first segment may be defined by a plurality of planar surfaces of the first segment, the groove of the second segment may be defined by a plurality of planar surfaces of the second segment, and the planar surfaces of the first and second segments may interface with planar surfaces of the insert when the insert is received by the grooves of the first and second segments.

Additionally, in some embodiments, the insert may include a planar forward face, a planar aft face located aft of the forward face along the central axis, and a pair of convex faces arranged opposite one another that interconnect the forward and aft faces. The groove of the first segment may be defined at least in part by a concave surface of the first segment extending substantially all the way from the forward face to the aft face of the first segment, the groove of the second segment may be defined at least in part by a concave surface of the second segment extending substantially all the way from the forward face to the aft face of the second segment, and the concave surfaces of the first and second segments may interface with the convex surfaces of the insert when the insert is received by the grooves of the first and second segments.

According to another aspect of the present disclosure, a gas turbine engine assembly may include a first segment and a second segment. The first segment may comprise ceramic matrix composite materials. The first segment may include an end portion having a plurality of fingers extending away from a central portion of the first segment circumferentially spaced from the end portion and a plurality of slots each defined by the central portion and at least one of the fingers. Each of the fingers may have a generally rectangular shape. The second segment may comprise ceramic matrix composite materials. The second segment may include an end portion having a plurality of fingers extending away from a central portion of the second segment circumferentially spaced from the end portion and a plurality of slots each defined by the central portion and at least one of the fingers. Each of the fingers may have a generally rectangular shape. The fingers of the first segment may be received by the slots of the second segment and the fingers of the second segment may be received by the slots of the first segment to at least partially establish a joint to secure the second segment to the first segment.

In some embodiments, the plurality of fingers of the end portion of the first segment may include two fingers and the plurality of slots of the end portion of the first segment may include two slots. The plurality of fingers of the end portion of the second segment may include two fingers and the plurality of slots of the end portion of the second segment may include two slots. One of the fingers of the end portion of the first segment may be generally positioned radially inward of the other of the fingers of the end portion of the first segment and one of the slots of the end portion of the first segment may be generally positioned radially outward of the other of the slots of the end portion of the first segment. One of the fingers of the end portion of the second segment may be generally positioned radially inward of the other of the fingers of the end portion of the second segment and one of the slots of the end portion of the second segment may be generally positioned radially outward of the other of the slots of the end portion of the second segment.

In some embodiments, the first segment may include a forward face, an aft face located aft of the forward face along the central axis, and a groove extending into the first segment from the forward face to the aft face, and the second segment may include a forward face, an aft face located aft of the forward face along the central axis, and a groove extending into the second segment from the forward face to the aft face. The assembly may include an insert that couples the second segment to the first segment, and the insert may be received by the grooves of the first and second segments to further secure the second segment to the first segment. The insert may have a generally rectangular shape. Additionally, in some embodiments, the insert may include a planar forward face, a planar aft face located aft of the forward face along the central axis, and a pair of convex faces arranged opposite one another that interconnect the forward and aft faces.

According to yet another aspect of the present disclosure, a gas turbine engine assembly may include a first segment and a second segment. The first segment may comprise ceramic matrix composite materials. The first segment may include a forward face, an aft face located aft of the forward face along a central axis, a central portion interconnecting the forward and aft faces, and an end portion circumferentially spaced from the central portion. The end portion may have at least one tongue extending away from the central portion between the forward face and the aft face and at least one groove defined by the central portion and the at least one tongue. The second segment may comprise ceramic matrix composite materials. The second segment may include a forward face, an aft face located aft of the forward face along a central axis, a central portion interconnecting the forward and aft faces, and an end portion circumferentially spaced from the central portion. The end portion may have at least one tongue extending away from the central portion between the forward face and the aft face and at least one groove defined by the central portion and the at least one tongue. The at least one tongue of the first segment may be received by the at least one groove of the second segment and the at least one tongue of the second segment may be received by the at least one groove of the first segment such that the first and second segments overlap each other to at least partially establish a joint to secure the second segment to the first segment.

In some embodiments, the at least one tongue and the at least one groove of the first segment may extend substantially all the way from the forward face to the aft face of the first segment and the at least one tongue and the at least one groove of the second segment may extend substantially all the way from the forward face to the aft face of the second segment. Additionally, in some embodiments, the assembly may include a plurality of fasteners that couple the second segment to the first segment, and the fasteners may be received by blind apertures formed in the at least one tongue of each of the first and second segments. Finally, in some embodiments still, the at least one tongue of the first segment may include a first tongue extending a first circumferential distance away from the central portion of the first segment and a second tongue extending a second circumferential distance away from the central portion of the first segment that is less than the first circumferential distance, and the at least one tongue of the second segment may include a third tongue extending a third circumferential distance away from the central portion of the second segment and a fourth tongue extending a fourth circumferential distance away from the central portion of the second segment that is less than the third circumferential distance.

According to another aspect of the present disclosure, a method of making a full hoop blade track may include forming first segments including ceramic matrix composite materials by a chemical vapor infiltration technique, forming second segments including ceramic matrix composite materials by a chemical vapor infiltration technique, securing each one of the first segments to one of the second segments, and processing the first segments together with the second segments secured thereto by a melt infiltration technique to form the blade track. Each of the first segments may have a forward face, an aft face located aft of the forward face along a central axis, a circumferential end face interconnecting the forward face and the aft face, and a groove extending into the circumferential end face from the forward face to the aft face. Each of the second segments may have a forward face, an aft face located aft of the forward face along a central axis, a circumferential end face interconnecting the forward face and the aft face, and a groove extending into the circumferential end face from the forward face to the aft face. Each one of the first segments may be secured to one of the second segments by inserting an insert into the grooves of the first and second segments.

According to another aspect of the present disclosure, a method of making a gas turbine engine assembly may include forming a first segment including ceramic matrix composite materials by a chemical vapor infiltration technique, forming a second segment including ceramic matrix composite materials by a chemical vapor infiltration technique, securing the first segment to the second segment, and processing the first segment together with the second segment secured thereto by a melt infiltration technique to form the gas turbine engine assembly. The first segment may have an end portion having a plurality of fingers extending away from a central portion of the first segment circumferentially spaced from the end portion and a plurality of slots each defined by the central portion and at least one of the fingers, and each of the fingers may have a generally rectangular shape. The second segment may have an end portion having a plurality of fingers extending away from a central portion of the second segment circumferentially spaced from the end portion and a plurality of slots each defined by the central portion and at least one of the fingers, and each of the fingers may have a generally rectangular shape. The first segment may be secured to the second segment such that the fingers of the first segment are received by the slots of the second segment and the fingers of the second segment are received by the slots of the first segment.

According to another aspect of the present disclosure, a method of making a gas turbine engine assembly may include forming a first segment including ceramic matrix composite materials by a chemical vapor infiltration technique, forming a second segment including ceramic matrix composite materials by a chemical vapor infiltration technique, securing the first segment to the second segment, and processing the first segment together with the second segment secured thereto by a melt infiltration technique to form the gas turbine engine assembly. The first segment may have a forward face, an aft face located aft of the forward face along a central axis, a central portion interconnecting the forward and aft faces, and an end portion circumferentially spaced from the central portion, and the end portion may have at least one tongue extending away from the central portion between the forward face and the aft face and at least one groove defined by the central portion and the at least one tongue. The second segment may have a forward face, an aft face located aft of the forward face along a central axis, a central portion interconnecting the forward and aft faces, and an end portion circumferentially spaced from the central portion, and the end portion may have at least one tongue extending away from the central portion between the forward face and the aft face and at least one groove defined by the central portion and the at least one tongue. The first segment may be secured to the second segment such that the at least one tongue of the first segment is received by the at least one groove of the second segment and the at least one tongue of the second segment is received by the at least one groove of the first segment so that the first and second segments overlap each other.

According to another aspect of the present disclosure, a gas turbine engine assembly may include a first segment, a second segment, and a joint. The first segment may include ceramic matrix composite materials. The first segment may have a first face, a second face spaced from the first face, a third face interconnecting the first and second faces, and a groove extending into the third face from the first face to the second face. The second segment may include ceramic matrix composite materials. The second segment may have a first face, a second face spaced from the first face, a third face interconnecting the first and second faces, and a groove extending into the third face from the first face to the second face. The joint may couple the first segment to the second segment. The joint may include an insert received by the grooves of the first and second segments to fix the second segment in place relative to the first segment.

According to another aspect of the present disclosure, a gas turbine engine assembly may include a first segment and a second segment. The first segment may include ceramic matrix composite materials. The first segment may have a first portion having a plurality of fingers extending away from a second portion of the first segment spaced from the first portion and a plurality of slots each defined by the second portion and at least one of the fingers, and each of the fingers may have a generally rectangular shape. The second segment may include ceramic matrix composite materials. The second segment may have a first portion having a plurality of fingers extending away from a second portion of the second segment spaced from the first portion and a plurality of slots each defined by the second portion and at least one of the fingers, and each of the fingers may have a generally rectangular shape. The fingers of the first segment may be received by the slots of the second segment and the fingers of the second segment may be received by the slots of the first segment to at least partially establish a joint to secure the second segment to the first segment.

According to another aspect of the present disclosure, a gas turbine engine assembly may include a first segment and a second segment. The first segment may include ceramic matrix composite materials. The first segment may have a first face, a second face spaced from the first face, a first portion interconnecting the first and second faces, and a second portion spaced from the first portion. The second portion may have at least one tongue extending away from the first portion between the first and second faces and at least one groove defined by the first portion and the at least one tongue. The second segment may include ceramic matrix composite materials. The second segment may include a first face, a second face spaced from the first face, a first portion interconnecting the first and second faces, and a second portion spaced from the first portion. The second portion may have at least one tongue extending away from the first portion between the first and second faces and at least one groove defined by the first portion and the at least one tongue. The at least one tongue of the first segment may be received by the at least one groove of the second segment and the at least one tongue of the second segment may be received by the at least one groove of the first segment such that the first and second segments overlap each other to at least partially establish a joint to secure the second segment to the first segment.

According to another aspect of the present disclosure, a method of making a gas turbine engine assembly may include forming first segments including ceramic matrix composite materials by a chemical vapor infiltration technique, forming second segments including ceramic matrix composite materials by a chemical vapor infiltration technique, securing each one of the first segments to one of the second segments, and processing the first segments together with the second segments secured thereto by a melt infiltration technique to form the gas turbine engine assembly. Each of the first segments may include a first face, a second face spaced from the first face, a third face interconnecting the first and second faces, and a groove extending into the third face from the first face to the second face. Each of the second segments may include a first face, a second face spaced from the first face, a third face interconnecting the first and second faces, and a groove extending into the third face from the first face to the second face. Each one of the first segments may be secured to one of the second segments by inserting an insert into the grooves of the first and second segments.

According to another aspect of the present disclosure, a method of making a gas turbine engine assembly may include forming a first segment including ceramic matrix composite materials by a chemical vapor infiltration technique, forming a second segment including ceramic matrix composite materials by a chemical vapor infiltration technique, securing the first segment to the second segment, and processing the first segment together with the second segment secured thereto by a melt infiltration technique to form the gas turbine engine assembly. The first segment may have a first portion having a plurality of fingers extending away from a second portion of the first segment spaced from the first portion and a plurality of slots each defined by the second portion and at least one of the fingers, and each of the fingers may have a generally rectangular shape. The second segment may have a first portion having a plurality of fingers extending away from a second portion of the second segment spaced from the first portion and a plurality of slots each defined by the second portion and at least one of the fingers, and each of the fingers may have a generally rectangular shape. The first segment may be secured to the second segment such that the fingers of the first segment are received by the slots of the second segment and the fingers of the second segment are received by the slots of the first segment.

According to another aspect of the present disclosure, a method of making a gas turbine engine assembly may include forming a first segment including ceramic matrix composite materials by a chemical vapor infiltration technique, forming a second segment including ceramic matrix composite materials by a chemical vapor infiltration technique, securing the first segment to the second segment, and processing the first segment together with the second segment secured thereto by a melt infiltration technique to form the gas turbine engine assembly. The first segment may have a first face, a second face spaced from the first face, a first portion interconnecting the first and second faces, and a second portion spaced from the first portion, and the second portion may have at least one tongue extending away from the first portion between the first and second faces and at least one groove defined by the first portion and the at least one tongue. The second segment may have a first face, a second face spaced from the first face, a first portion interconnecting the first and second faces, and a second portion spaced from the first portion, and the second portion may have at least one tongue extending away from the first portion between the first and second faces and at least one groove defined by the first portion and the at least one tongue. The first segment may be secured to the second segment such that the at least one tongue of the first segment is received by the at least one groove of the second segment and the at least one tongue of the second segment is received by the at least one groove of the first segment so that the first and second segments overlap each other While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A gas turbine engine assembly, the assembly comprising a first segment comprising ceramic matrix composite materials, the first segment including an end portion having a plurality of fingers extending circumferentially away from a central portion of the first segment spaced from the end portion, a plurality of slots each defined by the central portion and at least one of the fingers, and a groove that extends circumferentially into the end portion of the first segment from a forward face to an aft face located aft of the forward face of the first segment, each of the fingers having a generally rectangular shape, a second segment comprising ceramic matrix composite materials, the second segment including an end portion spaced apart circumferentially from the end portion of the first segment, the end portion having a plurality of fingers extending circumferentially away from a central portion of the second segment spaced from the end portion, a plurality of slots each defined by the central portion and at least one of the fingers, each of the fingers having a generally rectangular shape, and a grove that extends circumferentially into the end portion of the second segment from a forward face to an aft face located aft of the forward face of the second segment, and an insert that couples the second segment to the first segment, the insert being received by the grooves of the first and second segments to further secure the second segment to the first segment, wherein the fingers of the first segment are received by the slots of the second segment and the fingers of the second segment are received by the slots of the first segment to at least partially establish a joint to secure the second segment to the first segment, and wherein solidified matrix material forms part of the first segment, the second segment, and the insert to fix the second segment and the insert in place relative to the first segment.

2. The assembly of claim 1, wherein the plurality of fingers of the end portion of the first segment includes two fingers and the plurality of slots of the end portion of the first segment includes two slots.

3. The assembly of claim 2, wherein the plurality of fingers of the end portion of the second segment includes two fingers and the plurality of slots of the end portion of the second segment includes two slots.

4. The assembly of claim 3, wherein one of the fingers of the end portion of the first segment is generally positioned inward of the other of the fingers of the end portion of the first segment and one of the slots of the end portion of the first segment is generally positioned outward of the other of the slots of the end portion of the first segment.

5. The assembly of claim 4, wherein one of the fingers of the end portion of the second segment is generally positioned inward of the other of the fingers of the end portion of the second segment and one of the slots of the end portion of the second segment is generally positioned outward of the other of the slots of the end portion of the second segment.

6. The assembly of claim 1, wherein the insert has a generally rectangular shape.

7. The assembly of claim 1, wherein the insert includes a planar forward face, a planar aft face located aft of the forward face, and a pair of convex faces arranged opposite one another that interconnect the forward and aft faces.

8. A gas turbine engine assembly, the assembly comprising a first segment comprising ceramic matrix composite materials, the first segment including an end portion having a plurality of fingers extending away from a central portion of the first segment spaced from the end portion, a plurality of slots each defined by the central portion and at least one of the fingers, and a groove that extends into the first segment from a forward face to an aft face located aft of the forward face of the first segment, each of the fingers having a generally rectangular shape, a second segment comprising ceramic matrix composite materials, the second segment including an end portion having a plurality of fingers extending away from a central portion of the second segment spaced from the end portion, a plurality of slots each defined by the central portion and at least one of the fingers, each of the fingers having a generally rectangular shape, and a grove that extends into the second segment from a forward face to an aft face located aft of the forward face of the second segment, and an insert that couples the second segment to the first segment, the insert being received by the grooves of the first and second segments to further secure the second segment to the first segment, wherein the fingers of the first segment are received by the slots of the second segment and the fingers of the second segment are received by the slots of the first segment to at least partially establish a joint to secure the second segment to the first segment, wherein solidified matrix material forms part of the first segment, the second segment, and the insert to fix the second segment and the insert in place relative to the first segment, and wherein the insert includes a planar forward face, a planar aft face located aft of the forward face, and a pair of convex faces arranged opposite one another that interconnect the forward and aft faces.

9. The assembly of claim 8, wherein the plurality of fingers of the end portion of the first segment includes two fingers and the plurality of slots of the end portion of the first segment includes two slots.

10. The assembly of claim 9, wherein the plurality of fingers of the end portion of the second segment includes two fingers and the plurality of slots of the end portion of the second segment includes two slots.

11. A gas turbine engine assembly, the assembly comprising a first segment comprising ceramic matrix composite materials, the first segment including an end portion having a plurality of fingers extending away from a central portion of the first segment spaced from the end portion, a plurality of slots each defined by the central portion and at least one of the fingers, and a groove that extends into the first segment from a forward face to an aft face located aft of the forward face of the first segment, each of the fingers having a generally rectangular shape, a second segment comprising ceramic matrix composite materials, the second segment including an end portion having a plurality of fingers extending away from a central portion of the second segment spaced from the end portion, a plurality of slots each defined by the central portion and at least one of the fingers, each of the fingers having a generally rectangular shape, and a grove that extends into the second segment from a forward face to an aft face located aft of the forward face of the second segment, and an insert that couples the second segment to the first segment, the insert being received by the grooves of the first and second segments to further secure the second segment to the first segment, wherein the fingers of the first segment are received by the slots of the second segment and the fingers of the second segment are received by the slots of the first segment to at least partially establish a joint to secure the second segment to the first segment, wherein solidified matrix material forms part of the first segment, the second segment, and the insert to fix the second segment and the insert in place relative to the first segment, and wherein the groove of the first segment extends through the end portion and into the central portion of the first segment past an end of the plurality of slots included in the first segment, and wherein the groove of the second segment extends through the end portion and into the central portion of the second segment past an end of the plurality of slots included in the second segment.

12. The assembly of claim 11, wherein the first segment is a first blade track segment and the second segment is a second blade track segment.

13. The assembly of claim 11, wherein the insert includes a planar forward face, a planar aft face located aft of the forward face, and a pair of convex faces arranged opposite one another that interconnect the forward and aft faces.

14. The assembly of claim 11, wherein the plurality of fingers of the end portion of the first segment includes two fingers and the plurality of slots of the end portion of the first segment includes two slots.

15. The assembly of claim 14, wherein the plurality of fingers of the end portion of the second segment includes two fingers and the plurality of slots of the end portion of the second segment includes two slots.

16. The assembly of claim 11, wherein the insert has a generally rectangular shape.

* * * * *